US007768479B2

(12) United States Patent
Bezal et al.

(10) Patent No.: US 7,768,479 B2
(45) Date of Patent: Aug. 3, 2010

(54) CONTROL DEVICE IN A PLASMA DISPLAY PANEL

(75) Inventors: Jean-Raphaël Bezal, Meylan (FR); Gérard Morizot, Voiron (FR); Sylvain Thiebaud, Noyal sur Vilaine (FR)

(73) Assignee: Thomson Licensing, Boulogne-Billancourt (FR)

( * ) Notice: Subject to any disclaimer, the term of this patent is extended or adjusted under 35 U.S.C. 154(b) by 1574 days.

(21) Appl. No.: 10/912,791

(22) Filed: Aug. 6, 2004

(65) Prior Publication Data

US 2005/0030262 A1 Feb. 10, 2005

(30) Foreign Application Priority Data

Aug. 7, 2003 (FR) ..... 03 09729

(51) Int. Cl.
*G09G 3/28* (2006.01)

(52) U.S. Cl. ..... 345/68; 345/60; 345/211

(58) Field of Classification Search ..... 345/60–68, 345/204, 211–213; 315/169.4
See application file for complete search history.

(56) References Cited

U.S. PATENT DOCUMENTS

| | | | | |
|---|---|---|---|---|
| 5,227,696 | A | 7/1993 | Asars | |
| 5,994,929 | A | 11/1999 | Sano et al. | |
| 6,281,635 | B1 * | 8/2001 | Lee | 345/60 |
| 6,674,417 | B2 * | 1/2004 | Hsu et al. | 345/60 |
| 6,680,581 | B2 * | 1/2004 | Lee et al. | 315/169.3 |
| 7,009,588 | B2 * | 3/2006 | Lee et al. | 345/68 |
| 2001/0054994 | A1 | 12/2001 | Hsu et al. | |
| 2002/0033806 | A1 | 3/2002 | Vossen et al. | |

OTHER PUBLICATIONS

Search report dated Apr. 6, 2004.

* cited by examiner

*Primary Examiner*—Kevin M Nguyen
(74) *Attorney, Agent, or Firm*—Robert D. Shedd; Harvey D. Fried; James McKenzie

(57) ABSTRACT

To generate a rising or falling edge simultaneously on the electrodes Ys and Ysa of a plasma display cell, the invention provides for the use of the power recovery circuit of the control device in order to apply, to one of the electrodes Yas and Y, the rising edge applied to the other of the electrodes by a dedicated circuit.

4 Claims, 3 Drawing Sheets

CONTROL DEVICE IN A PLASMA DISPLAY PANEL

This application claims the benefit, under 35 U.S.C. 119 of French Patent Application 03/09729, filed Aug. 7, 2003.

FIELD OF THE INVENTION

The present invention relates to the generation of a rising or falling edge on the sustain and address-sustain electrodes of the cells of a plasma display.

BACKGROUND OF THE INVENTION

Simultaneously applying a same voltage rising or falling edge on the sustain electrode, hereafter denoted Ys, and the address-sustain electrode, hereafter denoted Yas, of a plasma display cell is a known technique. This case is illustrated in FIG. 1 which shows an example of voltage signals applied on the electrodes Ys and Yas of a display cell during a phase where the electrical charges in the display cells are equalized. This equalization phase, known as the reset phase, conventionally comprises an operation for forming electrical charges, known as priming, followed by an operation for adjusting the charges, also known as the "erase" of these charges, after which, ideally, the internal voltages within the cells are substantially the same. The electrical charges are reset in the discharge regions between coplanar electrodes, called coplanar discharge regions, and in the discharge regions between non-coplanar electrodes, called non-coplanar discharge regions.

SUMMARY OF THE INVENTION

The invention proposes a reduction in the power losses within the device for controlling the PDP during the application of a rising or falling edge to the electrodes Ys and Yas of the PDP cells by using power recovery means already present in the control device.

BRIEF DESCRIPTION OF THE DRAWINGS

The invention will be better understood upon reading the following description presented as a non-limiting example and with reference to the appended figures, among which.

The invention relates to a control device for a plasma display panel designed to generate a voltage rising or falling edge simultaneously on a sustain electrode Ys and on an address-sustain electrode Yas of a cell of the said plasma display panel, the voltage generated going, during the said rising or falling edge, from an initial value to a final value, power recovery means being connected between the said sustain electrode and an address-sustain electrode in order to recover power during the sustain phase of the discharges in the display cells, characterized in that it comprises first means for taking the voltage of one of the said sustain electrode and address-sustain electrode from the initial value to the final value, the said first means cooperating with the power recovery means in order to simultaneously bring the other of the said sustain electrode and address-sustain electrode to the final voltage.

The use of the power recovery means of the control device allows the use of a second dedicated circuit for applying the final voltage to the other of the said sustain electrode and address-sustain electrode to be eliminated and, at the same time, an additional consumption of power in the device to be avoided.

Advantageously, the said first means comprise, in the case of a rising edge, a switch and a diode connected in series between a voltage source for supplying the said final voltage value and earth, with the diode anode on the earth side, and an inductor connected, by a first end, to the point situated between the switch and the diode and, by a second end, to one of the said sustain electrode and address-sustain electrode. These means have the advantage of consuming very little power.

Figure 1:
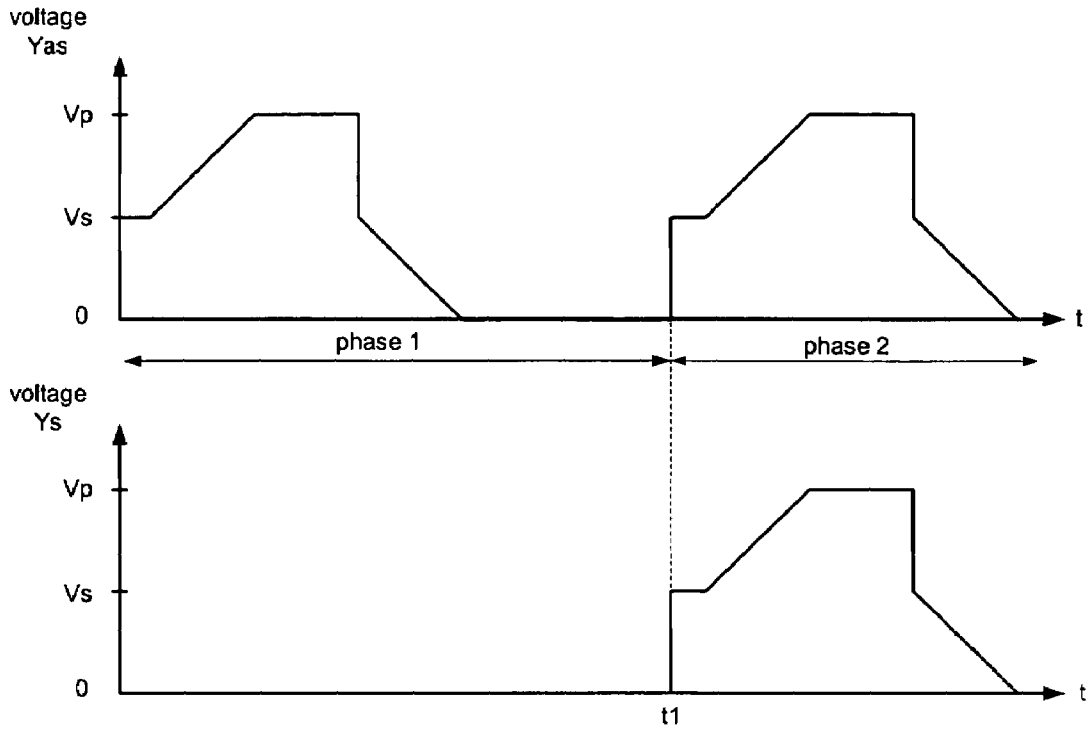
FIG. 1, already described above, is an example of voltage signals applied to the electrodes Ys and Yas of a cell in which a voltage rising edge is simultaneously applied to the 2 electrodes Ys and Yas of the cell.

As shown in FIG. 1, a reset operation is generally carried out first of all in the coplanar discharge regions (phase 1) and then in the non-coplanar discharge regions (phase 2). During phase 1, the priming and erase operations are performed by applying a voltage ramp to the electrodes Yas, the potential on the electrodes Ys and on the column electrodes of the PDP (plasma display panel) being held constant. More precisely, the formation of electrical charges in the discharge regions is obtained by applying a rising voltage ramp to the electrodes Yas and the adjustment of the latter is then obtained by applying a falling voltage ramp also to these same electrodes. In the same way, the operation for resetting the electrical charges in the non-coplanar discharge regions (phase 2) consists in applying a rising voltage ramp and then a falling voltage ramp to the electrodes Ys and Yas of the cells.

As can be seen in this figure, a voltage rising edge between zero volts and a voltage Vs is applied simultaneously to the two electrodes Ys and Yas of the cells at the time t1.

Currently, this rising edge is generated and applied separately to the two electrodes Ys and Yas which requires the use of 2 individual circuits to generate this edge. Each of these circuits introduces power losses.

DESCRIPTION OF PREFERRED EMBODIMENTS

Figure 2:
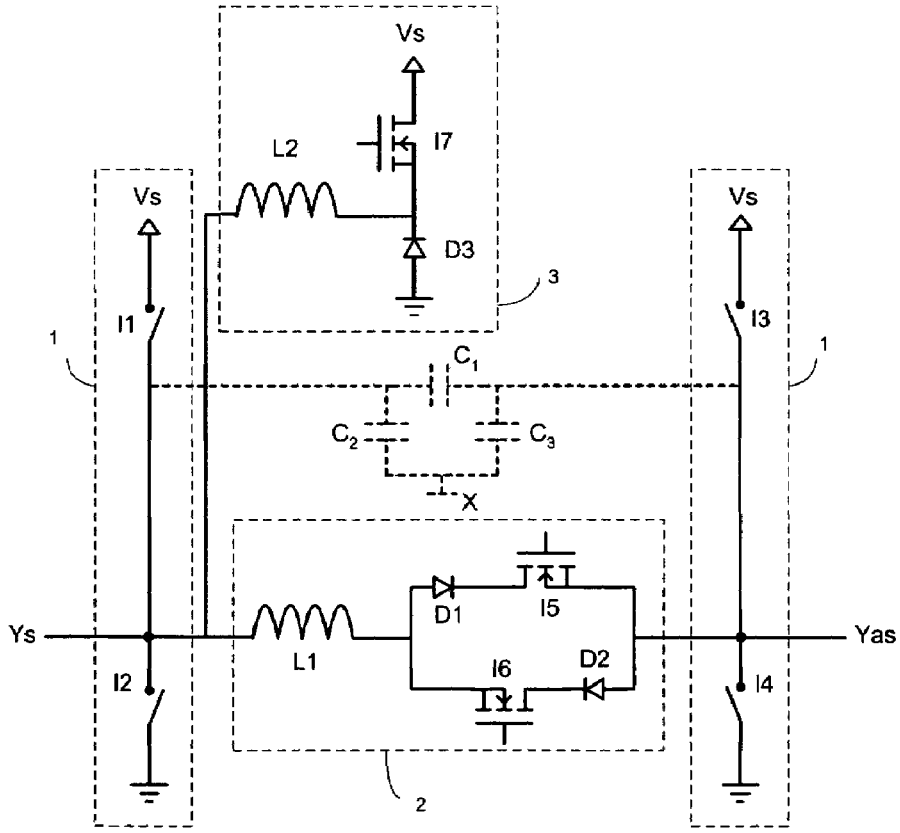
FIG. 2 is a circuit diagram of the control device of the invention.

With reference to FIG. 2, the control device of the invention comprises a circuit 1 for locking the voltages applied to the electrodes Ys and Yas, a power recovery circuit 2 and a means 3 of applying a voltage Vs to the electrode Ys. According to the invention, the means 3 cooperates with the power recovery circuit 2 in order to simultaneously apply the voltage from the means 3 to the two cell electrodes Ys and Yas of the plasma display. The capacitance between the electrodes Ys and Yas of the panel is represented by the capacitor $C_1$ in the figure. Similarly, the capacitance between, on the one hand, the electrodes Ys and Yas and, on the other hand, the column electrodes referenced X of the panel is represented in the figure by the capacitors $C_2$ and $C_3$. These capacitances are shown in the figure by dotted line.

The locking circuit 1 consists of four switches I1, I2, I3 and I4. Two switches, I1 and I2, are connected in series between a, power supply terminal receiving the voltage Vs and earth. The mid-point between these two switches is connected to the cell electrodes Ys of the display. The two other switches, I3 and I4, are also connected in series between a power supply terminal receiving the voltage Vs and earth. The mid-point between these two switches is connected to the cell electrodes Yas of the display.

The means 3 comprises a switch I7 connected in series with a diode D3 between a power supply terminal receiving the voltage Vs and earth. The diode D3 is oriented so as to prevent the current through the switch I7 from flowing to earth. An inductor L2 is also connected between the point situated between the switch I7 and the diode D3 on the one hand and the sustain electrode Ys on the other. The means 3 could, of course, just as well be connected to the address-sustain electrode Yas.

The power recovery circuit 2 is connected between the electrodes Ys and Yas of the display cells. This circuit is, for example, of the type described in the European Patent Application EP 0 704 834. It comprises an inductor L1 connected in series with a two-way switch between the electrodes Ys and Yas. The two-way switch is formed by a switch I5 in series with a diode D1 that allows the current to flow in one direction when the switch I5 is closed and by, connected in parallel, a switch I6 connected in series with a diode D2 that allows the current to flow in the opposite direction when the switch I6 is closed. Thus, when one or the other of the switches I5 and I6 is closed, the inductor L is connected in parallel with the display capacitance shown by the capacitors $C_1$, $C_2$ and $C_3$ in the FIG. 2 and forms a resonant circuit with the latter. The complete operation of this power recovery circuit 2 with the locking circuit 1 is described in detail in the European Patent Application EP 0 704 834. This power recovery circuit 2 is generally used during the sustain phase of the discharges in the cells. Outside of this phase, the switches I5 and I6 are generally open.

According to the invention, when it is desired to simultaneously apply a voltage Vs to the electrodes Ys and Yas, the switch I5 is closed in order to transmit the voltage Vs applied to the electrode Ys to the electrode Yas.

Figure 3:
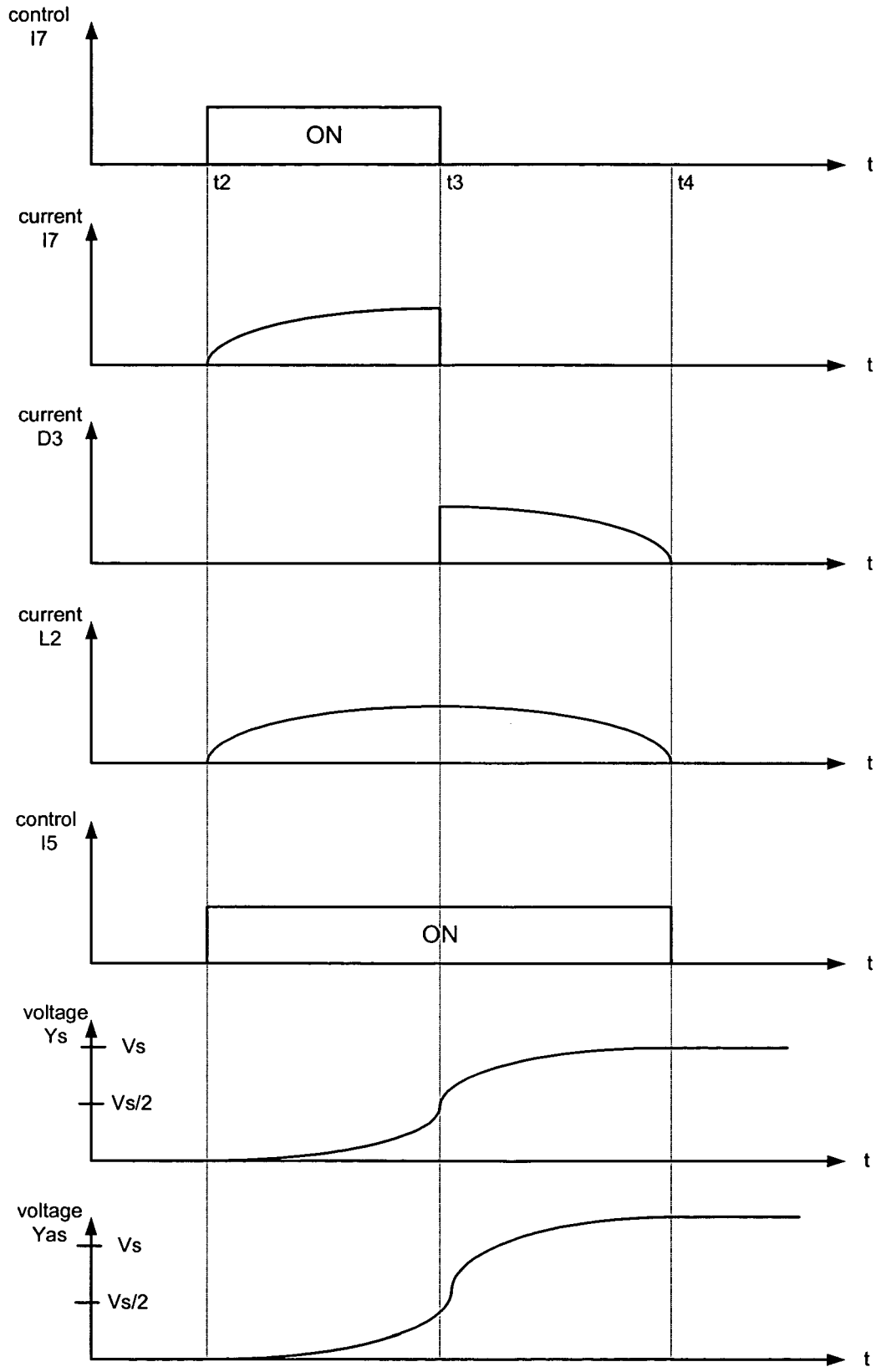
FIG. 3 illustrates the operation of the device in FIG. 2 for simultaneously bringing the electrodes Ys and Yas to the potential Vs.

This phase of operation of the control device of the invention is illustrated in FIG. 3. When the voltage Vs is to be applied to the electrodes Ys and Yas, the switches I7 and I5 are closed. The duration of the closed state for the switch I5 is equal to around twice that for the switch I7.

In more detail, at time t2, the switches I5 and I7 are closed. Advantageously, the switch I5 can even be closed shortly before the switch I7 in order to limit the switching losses in the switch I5. A current originating from the supply source of the voltage Vs is now delivered to the inductor L2. The current rises progressively in the inductor L2 and is retransmitted to the electrode Ys and, via the switch I5, to the electrode Yas. The voltage on the electrodes Ys and Yas therefore rises progressively. The voltage rise on the electrode Ys happens shortly before that of the electrode Yas owing to the presence of the inductor L1. At a variable time t3, the switch I7 is opened. The voltage across the terminals of the inductor L2 is inverted and the current in the latter starts to decrease. The continuity of the current in the inductor L2 is assured by the diode D3. This current continues to be delivered to the electrodes Ys and Yas. At a time t4 corresponding to the cancellation of the current in the inductor L2, the switch I5 is opened. The switches I1 and I3 are then closed and take over from the means 3 in supplying the voltage Vs. This closure of the switches I1 and I3 may indifferently be shortly before, at the same time as, or shortly after that of the switch I5.

In a less elaborate version, the means 3 could be eliminated and the switch I1 be used to raise the voltage of the electrode Ys. However, this embodiment will result in greater power losses than those of the device in FIG. 2. These losses would nevertheless be smaller than those of a device comprising dedicated circuits for raising the voltage of the electrodes Ys and Yas.

Figure 4:
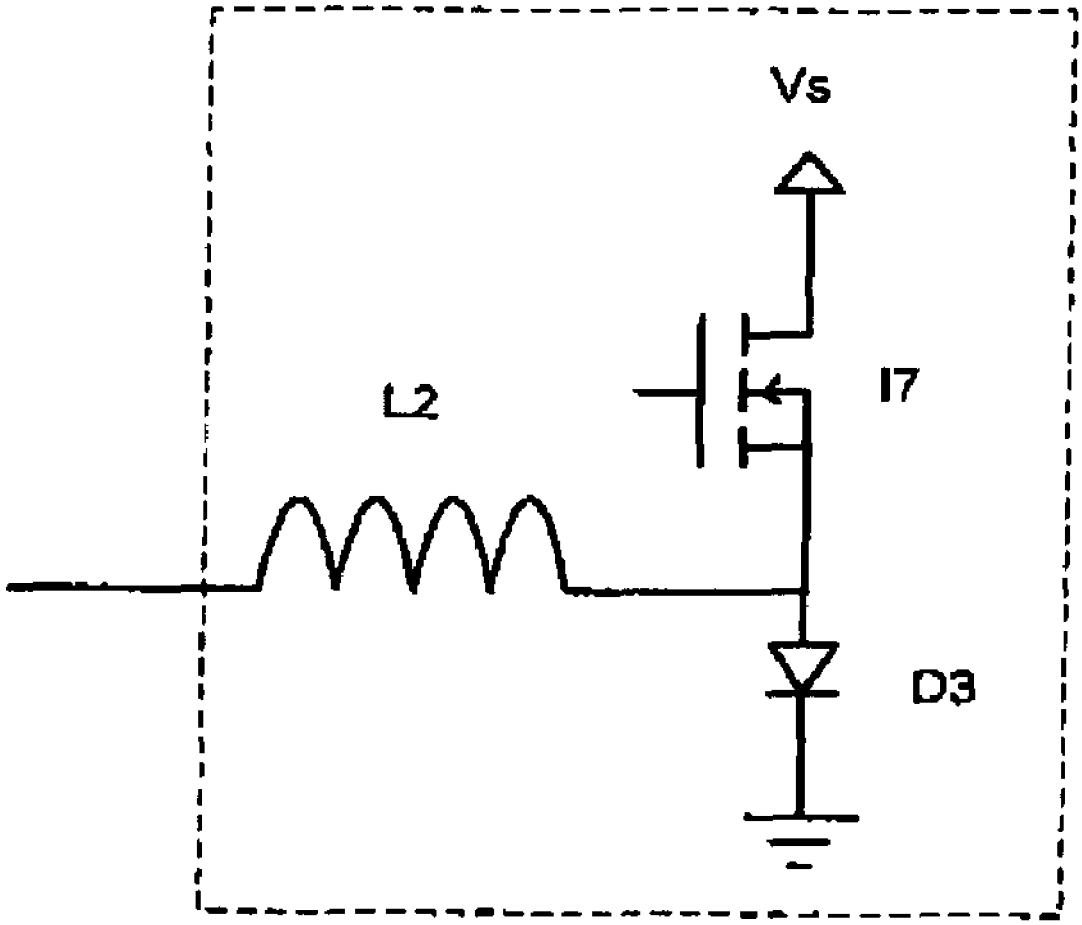
FIG. 4 illustrates a part of the circuit diagram of the control device, according to a specific embodiment of the invention.

It goes without saying that, as illustrated in FIG. 4, in the case of a falling edge and the application of a negative voltage Vs to the electrodes Ys and Yas of the display cells, the orientation of the diode D3 would be inverted, namely its cathode would then be connected to earth. In this case, it is the switch I6 of the power recovery circuit that would then be closed in place of the switch I5.

The advantages of this control device are manifold:

- a second circuit is not required to raise the voltage of the electrode Yas;
- the means 3 and the power recovery circuit 2 result in little power loss during the application of the voltage Vs to the two electrodes Ys and Yas;
- the means 3 does not interfere with the operation of the power recovery circuit 2 during the sustain phase of the discharges in the PDP cells.

The invention claimed is:

1. Control device for a plasma display panel designed to generate a same voltage rising edge or a same voltage falling edge simultaneously on a sustain electrode and on an address-sustain electrode of a cell of said plasma display panel, the voltage generated going, during said rising or falling edge, from an initial value to a final voltage value, power recovery circuitry being connected between said sustain electrode and said address-sustain electrode in order to recover power during the sustain phase of the discharges in the display cells, wherein said control device comprises first circuitry for taking the voltage of one of said sustain electrode and said address-sustain electrode from the initial voltage value to the final value of a positive polarity, said first circuitry cooperating with the power recovery circuitry in order to simultaneously bring the other voltage of said sustain electrode and said address-sustain electrode to said final voltage value of the positive polarity.

2. Device according to claim 1, wherein in the case of a rising edge, said first circuitry comprises a switch and a diode connected in series between a voltage source for supplying said final voltage value and earth, with the diode anode on the earth side, and an inductor connected, by a first end, to the point situated between the switch and the diode and, by a second end, to one of said sustain electrode and address-sustain electrode.

3. Device according to claim 1, wherein in the case of a falling edge, said first circuitry comprises a switch and a diode connected in series between a voltage source for supplying said final voltage value and earth, with the diode cathode on the earth side, and an inductor connected, by a first end, to the point situated between the switch and the diode and, by a second end, to one of said sustain electrode and address-sustain electrode.

4. Device according to claim 1, said power recovery circuitry comprising an inductor in series with one or more switches connected between said sustain electrode and said address-sustain electrode wherein when said first circuitry taking the voltage of one of the sustain electrode and the address-sustain electrode from the initial value to the final voltage value of the positive polarity, the switch or switches of the power recovery are closed in order to take the other voltage of the sustain electrode and the address-sustain electrode simultaneously to the same final value of the positive polarity.

* * * * *